United States Patent [19]

Biard

[11] Patent Number: 4,693,242

[45] Date of Patent: Sep. 15, 1987

[54] COUPLING CONNECTORS FOR RESPIRATOR MASKS

[75] Inventor: Jacques Biard, Montreuil, France

[73] Assignee: Fenzy S.A., Montreuil, France

[21] Appl. No.: 475,634

[22] Filed: Mar. 15, 1983

[30] Foreign Application Priority Data

Apr. 2, 1982 [FR] France ..... 82 05706

[51] Int. Cl.[4] ..... A62B 7/04

[52] U.S. Cl. ..... 128/204.26; 137/908; 137/491; 251/149.6

[58] Field of Search ..... 128/204.26, 204.27, 128/202.22, 205.24; 251/149.1, 149.3, 149.4, 149.6, 149.7; 137/491, 82, DIG. 9, 908

[56] References Cited

U.S. PATENT DOCUMENTS

| | | | |
|---|---|---|---|
| 2,406,888 | 9/1946 | Meidenbauer, Jr. | 128/204.26 |
| 3,995,626 | 12/1976 | Pearce, Jr. . | |
| 4,067,329 | 1/1978 | Winicki | 128/202.22 |
| 4,334,532 | 6/1982 | Jackson | 128/205.24 |
| 4,345,593 | 8/1982 | Sullivan | 128/204.26 |
| 4,361,145 | 11/1982 | Ekstrom et al. | 128/204.26 |

FOREIGN PATENT DOCUMENTS

| | | |
|---|---|---|
| 2060402 | 5/1981 | United Kingdom . |
| 2620170 | 11/1977 | Fed. Rep. of Germany . |
| 2842247 | 4/1980 | Fed. Rep. of Germany . |
| 1030137 | 6/1953 | France . |

*Primary Examiner*—Henry J. Recla
*Attorney, Agent, or Firm*—Young & Thompson

[57] ABSTRACT

This invention relates to a coupling connector attachable to and detachable from a respirator mask. The connector comprises a chamber which is arranged to be in communication with the mask in the attached position, a tube for connection to a source of pressurized breathing gas, a valve to admit or interrupt the gas flow, a pressure gauge device sensing the relative pressure prevailing within the chamber, and means of positively interlinking the said valve with the pressure gauge device.

According to the invention the connector has a feeler which is released or inserted depending on whether it is attached to the mask or not, said feeler being associated with the interlinkage means via means modifying the mode of operation, which are arranged to establish an operational mode under negative pressure or overpressure automatically depending on whether the feeler is free or inserted.

The connector is intended for respirator devices shut off in the open circuit condition.

11 Claims, 5 Drawing Figures

FIG. 3
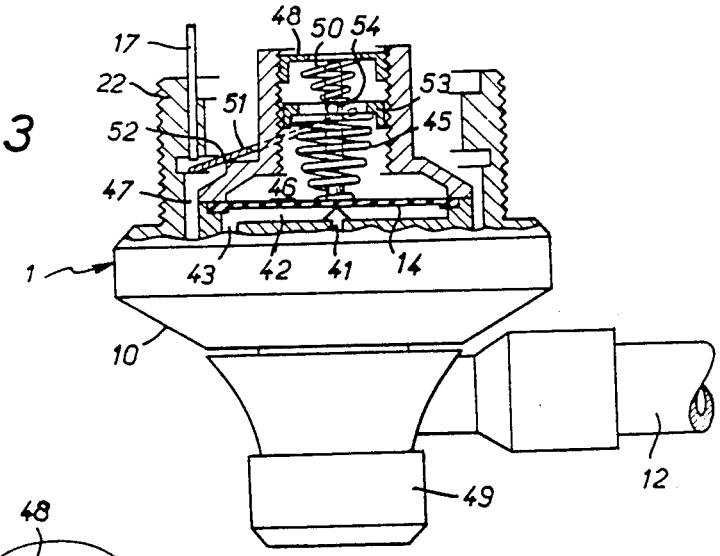
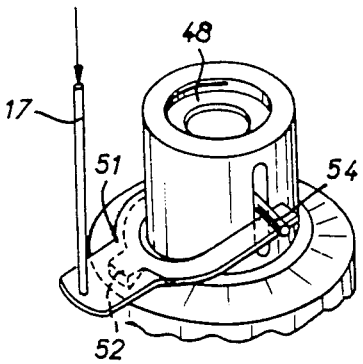
FIG. 4
FIG. 5
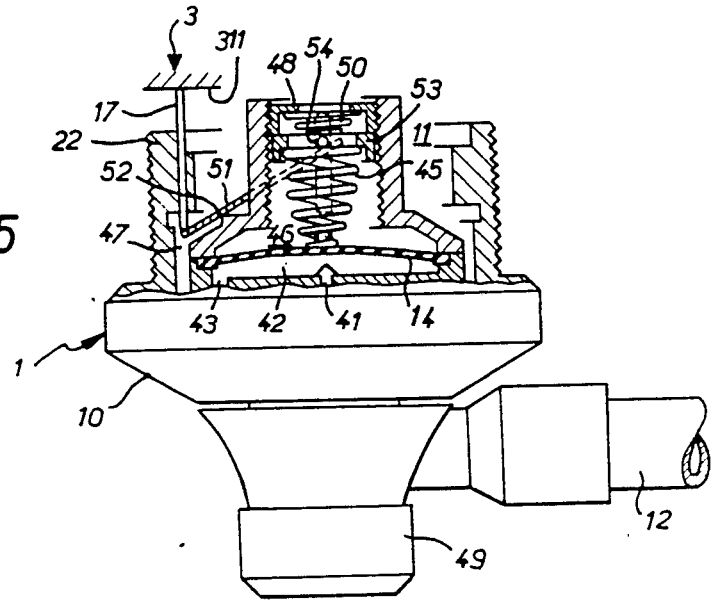

COUPLING CONNECTORS FOR RESPIRATOR MASKS

BACKGROUND OF THE INVENTION

The present invention relates to a coupling connector for attachment to and detachment from respirator devices which are shut off in the open circuit condition, and enabling the connection of the mask to a bottle of pressurised breathing gas.

The known connector devices comprise expansion means having one or two stages, and in the case of two-stage expansion means, the second is secured on the mask. This second stage is then integrated in a coupling connector which is either affixed on the snout of the mask or more commonly attachable to and detachable from the same.

In this last case, the fitting and removal may be performed, (for example by screwing (and unscrewing) or by insertion.

In the greater number of cases, the operation is arranged to occur under overpressure, to prevent penetration of toxic gas into the mask.

However, this operation under overpressure has two shortcomings:

At the instant in which the mask is placed in position on the face, the user either fits the mask and opens the bottle, which forces him to hold his breath for several seconds, which is not always an easy task, or he opens the bottle and places the mask over his face, which causes a loss of breathing gas for several seconds;

After the mask has been placed in position, it is impossible to check that it is gastight by shutting the mask intake by hand and by breathing in.

To eliminate these disadvantages, coupling devices have been devised which render it possible by a manual action to go through a stage of operation under vacuum initially, and then to change to the operating stage under overpressure.

This possibility is very risky and sometimes forbidden with full justification, since it does not provide any assurance against wrong handling causing the vacuum setting to be established whilst the user is present within the danger area.

SUMMARY OF THE INVENTION

It is an object of the invention to eliminate or minimise these shortcomings and to this end relates to a coupling connector of the kind which may be attached to and detached from the snout of a respirator mask, and comprising an internal chamber arranged for communication with the mask in the attached position, a tube for connection to a source of pressurised breathing gas, a valve for admitting or shutting off the flow of gas under pressure, a pressure gauge device sensing the relative pressure prevailing within the chamber, and means of positively interlinking the said valve with the pressure gauge device. According to the invention, the connector comprises a feeler which is free or inserted depending on whether the connector is installed on the mask or disconnected from the latter, this feeler being associated with said interlinkage means via means for modifying the mode of operation, said modifying means being arranged for establishing a mode of operation under vacuum or a mode of operation under overpressure depending on whether the feeler is in the free or inserted condition.

The fact that the connector has a device which renders it possible to be set automatically to vacuum operation when it is not coupled to the mask, and to overpressure as soon as it is connected, renders it possible to avoid or minimise all the disadvantages referred to above.

BRIEF DESCRIPTION OF THE DRAWINGS

In order that the invention may be more clearly understood, reference will now be made to the accompanying drawings which show certain embodiments thereof by way of example and in which:

FIG. 3 is a partial diagrammatical cross-section of a second embodiment of a connector in accordance with the invention when separated from the snout of a mask on which it is intended to be fitted, FIG. 4 is a view in perspective of a feeler device and of return or deflector means for modifying the mode of operation, with which the connector of FIG. 3 is fitted, and FIG. 5 is a diagrammatical cross-section of the connector of FIG. 3 when installed on the mask.

DETAILED DESCRIPTION OF THE PREFERRED EMBODIMENTS

Figure 1:
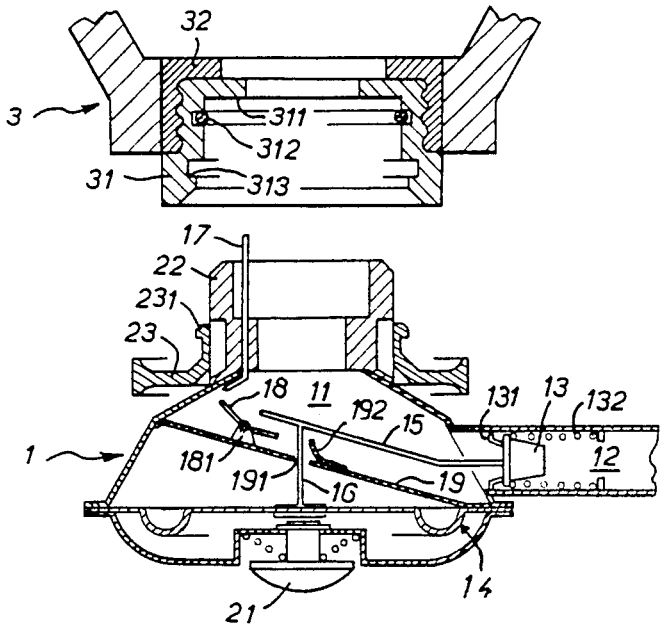
FIG. 1 is a diagrammatical cross-section of a first embodiment of an inventive connector and of the snout of a mask on which this connector is intended to be installed, in the separated position.

Referring now to the drawings a connector 1 attachable to and detachable from the snout 3 of a respirator mask commonly comprises an internal chamber 11 arranged to be in communication with the mask in the installed position, a tube 12 for connection to a source of pressurised breathing gas (not shown), a valve 13 intended to admit or shut off the flow of pressurised gas, a manometric diaphragm 14 sensing the relative pressure within the chamber 11 and means of interlinking the valve 13 with the pressure detector diaphragm.

Figure 2:
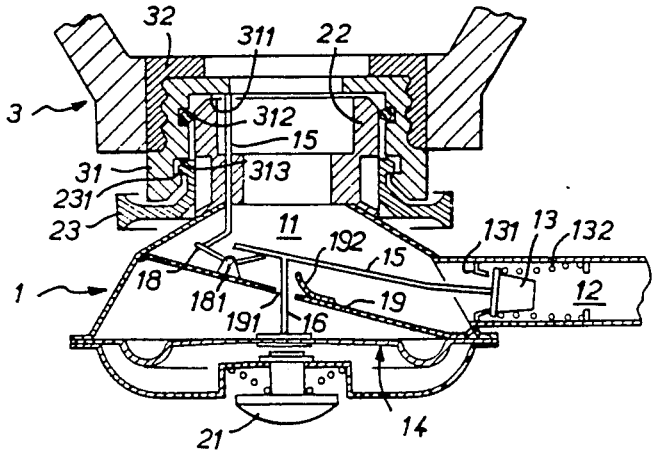
FIG. 2 is a diagrammatical cross-section of the said members when the connector is installed.

In the embodiment illustrated in FIGS. 1 and 2, these interlinkage means comprise a lever 15 slightly with respect to the longitudinal axis of the valve 13 and fastened to the same, and a rod 16 secured to the diaphragm 14 and rising in the chamber 11 at right angles to this diaphragm, the lever 15 and the rod 16 being joined in such manner that a vacuum in the chamber 11 causes the valve 13 to be drawn away from its seat 131 against the action of a return spring 132, at least in one area of the contact surface between these two elements 13, 131.

In accordance with the invention, the connector 1 comprises a feeler 17 projecting outside the chamber 11 and translatorily movable between a "free" idle position which it assumes when the connector is not coupled to the snout 3, and an "inserted" position when the connector is coupled to the snout; this feeler 17 is associated with the interlinkage means via means modifying the mode of operation, which are arranged to establish a mode of operation under vacuum or under overpressure depending on whether the feeler 17 is in the free or inserted position, respectively.

In the embodiment illustrated in FIGS. 1 and 2, the modifying means comprise a two-armed bent spring 18, formed by a metal wire of the piano wire variety which is pivotally arranged on a central pin 181 borne by a plate 19 passing through the chamber 11 substantially parallel to the position occupied by the lever 15 when the valve 13 is applied against its seat. The spring 18 is positioned in such manner that, on the one hand, one of its arms is positioned close to the extremity of the feeler opposite to that projecting from the chamber when it is in the "free" position, and that the other arm should then be close to the lever 15 for actuation of the valve, and on the other hand that the first arm should be displaced by the extremity of the feeler in the "inserted" position, the second arm then exerting a lateral thrust on the lever 15 to move the valve off its seat over a part of the contact surface of these two elements. The plate 19 may also carry stop devices to limit the displacement of the first arm of the spring 18 during its tipping around the pivot pin 181 under the action of the feeler 17. The plate 19 is provided with an opening 191 for traversal by the rod 16 and if desired for pressure distribution at either side, this distribution being attainable by the fact that the opening 191 has a substantially greater cross-section than that of the rod 16, and/or by complementary openings (not shown in FIGS. 1 and 2). In the area of the opening for pressure distribution, the plate 19 also has a deflector strip 192 for ducting the air emerging from the valve and generating a Venturi action for momentarily generating a vacuum close to the diaphragm 14 when this is needed, as will hereinafter be described.

The connector 1 also comprises a direct access lifter 21 arranged for manual operation of the diaphragm 14 and consequently of the interlinkage means 15,16 in the direction for opening the valve 13 if need be.

The feeler 17 is arranged to be translatorily displaceable in a bearing barrel 22 intended to penetrate into a receiving member 31 situated in the mask snout 3, more specifically within a secured ring 32. To this end, the receiving member 31 comprises a front stop shoulder or step 311 intended to cause insertion of the feeler upon fitting the connector on the snout; to ensure a seal for the connection, a toroidal joint 312 is situated within the receiving member 31.

Around the barrel 22 is situated an insertion element 23 made in the form of a resilient collar comprising levers, provided with an outer peripheral lip 231 for engagement in an annular groove 313 formed within the receiving member 31 to hold the connector 1 in the mask snout 3 in the plugged-in installed position.

When the connector 1 is separate, the valve 13 is thus held against its seat by the spring 132 and the overpressure in the coupling tube 12, and the connector does not supply respiratory gas. Only a vacuum in the chamber 11, or an action on the direct access lifter 21, causes the tilting or the lever 15 and consequently the opening of the valve 13, the spring 18 then not being in contact with the lever 15 because the feeler 17 is in the free position. The operation consequently occurs in the vacuum mode.

Upon installing the connector 1 on the snout 3, the feeler 17 passes into the inserted position and causes tilting of the spring 18 actuating the lever 15 which causes the valve 13 to open; the action of the spring 18 is then balanced by the overpressure exerted on the diaphragm 14, which recloses the valve 13, the latter not opening again under the overpressure tends to diminish during an intake of breath.

The structure and arrangement of the connector render it possible for an adequate vacuum to prevail below the diaphragm in case of a violent intake of breath by the user, to maintain the opening of the valve 13 and consequently a very small overpressure within the connector and the mask, which even in this case prevents penetration of the ambient noxious gas against which the respirator apparatus is intended to provide an assurance. The operation then occurs constantly in the overpressure mode.

When the connector 1 is detached from the snout 3, the feeler returns to the free position, and the operation again occurs in the vacuum mode.

Nevertheless, should the user so wish, the connector may operate as a constant vacuum valve, or as a screw valve, simply by modifying some of the component parts (the feeler 17 in the first case, the insertion element 23 in the second case).

In the embodiment of FIGS. 3 to 5, the connector 1 comprises a micro-regulator of a known kind situated within a case 10 the upper part of which has been shown removed, which in communication with the tube 12 for connection to the source of breathing gas comprises a breathing gas inlet passage whose external walls form the seat of a valve (not visible in FIGS. 3 to 5) made in the form of a flexible diaphragm by-passed by a calibrated jet; the surface of the diaphragm delimited by the inlet passage beside this passage being smaller than at the other side, the diaphragm thus normally bears against its seat. In this kind of connector, the side of the diaphragm opposed to the inlet passage delimits a chamber into which opens the calibrated jet; into this chamber also leads an interlinkage jet 41 in communication on the one hand with the outside via a passage 43; this interlinkage chamber 42 on the one hand comprises the pressure-sensing control diaphragm 14 exposed at the other side from the interlinkage chamber 42 to the action of a return spring 45 situated in an internal control chamber 46 in communication with the inside of the mask snout; the pressure-sensing control diaphragm 14 is normally moved by the return spring 45, in such manner as to plug the interlinkage jet 41; an intercommunication pipe 47 connects the space surrounding the inlet passage also within the mask snout, and the set of cavities in direct communication with the snout forming the chamber 11. Thus, when the user breathes in within his mask, he generates a vacuum in the area of the pressure-sending control diaphragm 14 which frees the interlinkage jet 41; the pressure in the chamber in contact with the valve diminishes since the flow rate authorised by the calibrated jet is much smaller than that of the interlinkage jet 41; the diaphragm forming a valve is consequently moved off its seat, and the breathing gas may flow from the inlet passage to the communication pipe 47, that is from the breathing gas bottle to the mask. The adjustment of the overpressure is performed by means of the return spring 45 and of an adjusting screw 48, the return spring 45 bearing against the centre of the pressure-sensing control diaphragm 14. A direct access tap 49 may be operated by the user to by-pass the valve.

In this embodiment, a device comprising a feeler 17 housed in a bearing barrel 22 and having return means for modifying the mode of operation comprising a complementary spring 50 (having a greater stiffness than that of the return spring 45), renders it possible to have an operation under vacuum when the feeler 17 is free and under overpressure when it is inserted under the action of the stop 311 of the snout 3. The return means altering the mode of operation also comprises a lever 51 bearing against a step or shoulder 52 formed on the outer side of the control chamber 46, this lever being actuated at one of its extremities by the feeler 17 and at its other extremity produced in the form of a fork operating a cursor 53 situated between the return spring 45 and the complementary spring 50 via a sliding cross member 54 linking the two legs of the fork, this cross member being attached to the cursor 53; in practice, the movement of the cross member is permitted thanks to slideways provided in the walls of the chamber 46. The return spring 45 and the complementary spring 50 are thus installed in series between the pressure-sensing diaphragm 14 and the adjusting screw 48. When the feeler 17 is free, the cursor 53 is exposed to the action of both springs, and these exert a fraction of the total force applied, in the proportion of their own stiffness, on the pressure-sensing diaphragm 14; when the feeler 17 is inserted, the lever 51 compresses the complementary spring 50, and the return spring 45 then comes into action practically by itself against the displacement of the pressure-sensing diaphragm 14. In conclusion, when the feeler 17 is free, the two springs 45, 50 are in action and the operation occurs under vacuum, whereas when the feeler 17 is inserted by the front stop shoulder of the mask snout, the complementary spring 50 of the return means modifying the mode of operation is practically deactivated and only the return spring 45 acting direct on the control diaphragm is in action, and the operation occurs under overpressure. The connector may also comprise complementary rings allowing the microregulator to be connected to the mask, for example by screwing or insertion.

It will be apparent that the invention is not limited to the embodiments described and illustrated in the foregoing, and other embodiments may be specified without departing from the scope of the invention as defined by the appended claims.

I claim:

1. In a coupling connector attachable to and detachable from the snout of a respirator mask comprising a housing enclosing a body defining a control chamber having first and second ends, said housing having outlet means adapted to be connected to said snout and be in communication with the mask when in said connected position, said first end of said chamber being in communication with said outlet means, tube means connected to said housing for connection of a source of pressurized breathing gas, a control valve means in said housing to admit or shut off a main flow of gas under pressure from said tube means to said outlet means, biasing means applying a predetermined biasing force on said control valve means to maintain said control valve means in a closed position, said control valve means further comprising a pressure-sensing control diaphragm delimiting the control chamber at the second end thereof, an interlinkage chamber delimited at one side and separated from said control chamber by said pressure-sensing control diaphragm, an interlinkage jet leading into said interlinkage chamber, a return spring mounted between said first end of said control chamber and said pressure-sensing control diaphragm for pushing said control diaphragm towards the interlinkage jet; the improvement in which said control valve means includes a complementary spring, mounted within said control chamber, in series with the return spring, bearing means, against which said complementary spring bears, disposed at said first end of said control chamber, a movable cursor placed in between the return spring and the complementary spring, aperture means in said body and extending longitudinally along opposite sides of said body adjacent said movable cursor, said cursor extending exteriorly from opposite sides of said body through said aperture means, a shoulder formed on the exterior of said body, a lever bearing against said shoulder, said lever having at one end a fork engaging opposite ends of said movable cursor and having an opposite end, a feeler member which is constrained outside said body and inside said housing in a first position when said mask is connected to said snout to engage said opposite end of said lever to apply a force against the complementary spring thereby deactivating the complementary spring when said outlet is connected to said snout and freely movable to a second position when said mask is disconnected from said snout whereby both springs are then stressed which causes said pressure sensing diaphragm to close said interlinkage jet as long as said pressure-sensing control diaphragm senses a pressure equal to or greater than said ambient pressure when said outlet is disconnected from said snout.

2. A connector according to claim 1, wherein said bearing means is an adjusting screw threadably engaged at said first end of said control chamber.

3. A demand valve comprising a housing having an inlet adapted to be connected to a source of breathing gas and an outlet with means adapted for demountable connection of said outlet to an inlet opening of breathing interface means; valve means adapted to control a main gas flow from said inlet to said outlet; pressure sensing means in said housing for sensing pressure variations caused by the respiration of a user of said breathing interface means; said housing further comprising an internal chamber in communication with said inlet and said outlet of said housing, said pressure sensing means being mounted in said internal chamber for sensing the pressure prevailing in said internal chamber; said valve means being operatively associated with said pressure sensing means for controlling said main gas flow in response to said pressure variations, said valve means comprising a valve member and means interlinking said valve member and said pressure sensing means; biasing means adapted to apply a bias to said valve means constructed and arranged such that in a first position of said biasing means said valve means provides a positive pressure mode of operation and in a second position of said biasing means said main gas flow is shut off if said pressure sensing means senses pressure in said chamber equal to or greater than an ambient pressure; and means associated with said outlet of said housing for actuating said biasing means, said actuating means being engageable with the inlet opening of said breathing interface means such that when said outlet is connected to said breathing interface means, said biasing means is constrained to be in its first position and when said outlet is disconnected, said biasing means is adapted to move to its said second position; said demand valve further comprising a return spring pushing said valve member towards its shut off position; and wherein said interlinking means comprises a lever having first and second ends, said first end of said lever being secured to said valve member, and a rod extending from adjacent said second end of said lever and secured to said pressure gauge device; the biasing means including a bent spring movable around a pivot pin mounted adjacent said second end of said lever such that in the said first position the bent spring is tilted by the said actuating means and a first end of the spring engages said second end of said lever to apply a bias to said valve means whereby the said valve member remains open as long as the pressure in the respirator mask is below the pressure required in the positive pressure mode; and in the said second position the bent spring is free.

4. A demand valve according to claim 3, wherein said actuating means includes a feeler which is constrained in a first position to engage a second end of said bent spring when said outlet is connected to said breathing interface means and freely movable to a second position when said outlet is disconnected.

5. In combination with a respirator mask having an inlet opening, a coupling connection comprising a housing having an inlet adapted to be connected to a source of breathing gas and an outlet with means adapted for demountable connection of said inlet opening of said respirator mask; valve means adapted to control a main gas flow from said inlet to said outlet; pressure sensing means in said housing for sensing pressure variations caused by the respiration of a user of said respirator mask; said housing further comprising an internal chamber in communication with said inlet and said outlet of said housing, said pressure sensing means being mounted in said internal chamber for sensing the pressure prevailing in said internal chamber; said valve means being operatively associated with said pressure sensing means for controlling said main gas flow in response to said pressure variations, said valve means comprising a valve member and means interlinking said valve member and said pressure sensing means; biasing means adapted to apply a bias to said valve means constructed and arranged such that in a first position of said biasing means said valve means provides an overpressure mode of operation and in a second position of said biasing means said main gas flow is shut off if said pressure sensing means senses pressure in said chamber equal to or greater than an ambient pressure; and means associated with said outlet of said housing for actuating said biasing means, said actuating means being engageable with the inlet opening of said respirator mask such that when said outlet is connected to said inlet opening, said biasing means is constrained to be in its first position and when said outlet is disconnected, said biasing means is adapted to move to its said second position; said demand valve further comprising a return spring pushing said valve member towards its shut-off position; and wherein said interlinking means comprises a lever having first and second ends, said first end of said lever being secured to said valve member, and a rod extending from adjacent said second end of said lever and secured to said pressure gauge device; the biasing means including a bent spring movable around a pivot pin mounted adjacent said second end of said lever such that in the said first position the bent spring is tilted by the said actuating means and a first end of the spring engages said second end of said lever to apply a bias to said valve means whereby the said valve member remains open as long as the pressure in the respirator mask is below the pressure required in the positive pressure mode; and in the said second position the bent spring is free.

6. A connector according to claim 5, wherein said actuating means includes a feeler which is constrained in a first position to engage a second end of said bent spring when said outlet is connected to said snout and is freely movable to a second position when said outlet is disconnected.

7. In a coupling connector attachable to and detachable from the snout of a respirator mask comprising a housing having an internal chamber and outlet means adapted to be connected to said snout and be in communication with the mask when in said connected position, tube means connected to said housing for connection of a source of pressurized breathing gas to said internal chamber, valve means in said housing to admit or shut off the flow of gas under pressure from said tube means to said outlet means, biasing means applying a predetermined biasing force on said valve means to maintain said valve means in a closed position, pressure sensing means in said housing for sensing the relative pressure with respect to atmospheric pressure prevailing in the chamber, linkage means interlinking said valve means with said pressure sensing means such that when a force, caused by pressure above or below atmospheric pressure in an amount greater than said predetermined biasing force, is sensed in said chamber by said pressure sensing means, said valve means opens to provide gas flow from said tube means to said outlet means; the improvement in which said coupling connector includes feeler means movably mounted in said housing adjacent said outlet means and movable to a first position when said outlet means is not connected to said snout and to a second position when said outlet is connected to said snout, modifying means operably connected between said feeler means and said linkage means for modifying the mode of operation of said valve means by providing an additional biasing force on said valve means to maintain said valve means in an open position, said modifying means being arranged such that when said feeler means is in said first position, said modifying means disengages said additional biasing force from said valve means whereby said valve means opens in response to pressures sensed in said chamber by said pressure sensing means above or below atmospheric pressure in an amount greater than said predetermined biasing force and when said feeler means is in said second position, said modifying means imposes said additional biasing force on said valve means whereby said valve means is maintained in its open position and closes in response to pressures sensed in said internal chamber by said pressure sensing means greater than said additional biasing force.

8. A connector according to claim 7, wherein said biasing means is a return spring pushing said valve means towards its closing position.

9. A connector according to claim 7, wherein said pressure sensing means is a manometric diaphragm.

10. A connector according to claim 9, wherein said linkage means comprises a lever fastened to said valve means and a rod secured to said diaphragm.

11. A connector according to claim 10, wherein said modifying means includes a bent spring having two arms, one said arm being engaged with said feeler means, the other said arm being engaged with said lever when said feeler means is in said second position, said bent spring being free when said feeler means is in said first position.

* * * * *